US010210783B2

(12) United States Patent
Lin et al.

(10) Patent No.: US 10,210,783 B2
(45) Date of Patent: Feb. 19, 2019

(54) APPARATUS AND METHOD FOR SENSING DISPLAY PANEL

(71) Applicant: Novatek Microelectronics Corp., Hsinchu (TW)

(72) Inventors: Chun-Chieh Lin, Taipei (TW); Shang-I Liu, Kaohsiung (TW); Hua-Gang Chang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/112,775

(22) Filed: Aug. 27, 2018

(65) Prior Publication Data

US 2018/0366046 A1 Dec. 20, 2018

Related U.S. Application Data

(63) Continuation-in-part of application No. 15/259,052, filed on Sep. 8, 2016, now Pat. No. 10,068,528.

(51) Int. Cl.

| | |
|---|---|
| ***G09G 3/00*** | (2006.01) |
| ***G09G 3/3266*** | (2016.01) |
| ***G09G 3/3275*** | (2016.01) |
| ***G09G 3/3233*** | (2016.01) |

(52) U.S. Cl.

CPC ..... *G09G 3/006* (2013.01); *G09G 3/3233* (2013.01); *G09G 3/3266* (2013.01); *G09G 3/3275* (2013.01); *G09G 2310/0286* (2013.01); *G09G 2310/08* (2013.01); *G09G 2320/043* (2013.01); *G09G 2330/12* (2013.01)

(58) Field of Classification Search

CPC ..... G09G 3/3648; G09G 3/3677; G09G 2300/0426; G09G 2300/0465; G09G 2310/0297; G09G 2320/0223

See application file for complete search history.

(56) References Cited

U.S. PATENT DOCUMENTS

| | | | | |
|---|---|---|---|---|
| 2009/0027376 A1* | 1/2009 | Kwon | ..... | G09G 3/3233 345/214 |
| 2011/0063281 A1* | 3/2011 | Hsu | ..... | G09G 3/3648 345/213 |

* cited by examiner

*Primary Examiner* — Shaheda Abdin

(74) *Attorney, Agent, or Firm* — JCIPRNET

(57) ABSTRACT

An apparatus and a method for sensing a display panel are provided. The apparatus includes a source driving circuit and a sensing circuit. The source driving circuit is coupled to data lines to drive the pixel circuits according to a scan-line period for scanning one of the scan lines. The sensing circuit is coupled to a plurality of pixel circuits. The sensing circuit senses characteristics of the pixel circuits according to the scan-line period for scanning one of the scan lines, wherein the scan-line period comprises a display data period and a test data period. In the test data period, a corresponding pixel circuit receives test data, and the sensing circuit senses the electrical characteristic of the corresponding pixel circuit. In the display data period, the corresponding pixel circuit receives display data from a corresponding data line, and the sensing circuit does not sense the corresponding pixel circuit.

20 Claims, 9 Drawing Sheets

APPARATUS AND METHOD FOR SENSING DISPLAY PANEL

CROSS-REFERENCE TO RELATED APPLICATION

This application is a continuation-in-part application of and claims the priority benefit of a prior application Ser. No. 15/259,052, filed on Sep. 8, 2016, now allowed. The entirety of the above-mentioned patent application is hereby incorporated by reference herein and made a part of this specification.

BACKGROUND OF THE INVENTION

Field of the Invention

The present invention relates to a display apparatus, and more particularly relates to an apparatus and a method for sensing display panel.

Description of Related Art

In general, for each pixel circuit of an active matrix organic light emitting diode (AMOLED) display panel, two transistors and a capacitor (referred as 2T1C structure) can be used to drive the organic light emitting diode (OLED). By controlling the current of the OLED, the gray scale/luminance of the pixel circuit can be determined. However, the gray scale/luminance of the pixel circuit may not be presented as expected due to some unsatisfactory characteristics of the AMOLED display panel. The characteristics of different pixel circuits are also different due to the effects of process variation and the aging rate differences between elements. By sensing the respective characteristics of the pixel circuits in real-time, and compensating the pixel circuits according to the sensing result correspondingly, the gray scale/luminance of the pixel circuit can be presents as expected as possible. Accordingly, it is an important issue to sense the characteristics of the pixel circuit in real time.

SUMMARY OF THE INVENTION

The present invention provides an apparatus and a method for sensing display panel, which can sense the electrical characteristics of pixel circuits in real time.

In an embodiment of the present invention, an apparatus for sensing display panel is provided. The display panel includes a plurality of scan lines, a plurality of data lines and a plurality of pixel circuits. A data input terminal and a gate terminal of a corresponding pixel circuit of the pixel circuits are coupled to a corresponding data line of the data lines and a corresponding scan line of the scan lines respectively. The apparatus includes a source driving circuit and a sensing circuit. The source driving circuit is coupled to the data lines to drive the pixel circuits according to a scan-line period for scanning one of the scan lines. The sensing circuit is coupled to a plurality of pixel circuits. The sensing circuit senses characteristics of the pixel circuits according to the scan-line period for scanning one of the scan lines, wherein the scan-line period comprises a display data period and a test data period. In the test data period within the scan-line period, the source driving circuit provides test data to the pixel circuits, and the sensing circuit senses the electrical characteristic of the corresponding pixel circuit. In the display data period within the same scan-line period, the source driving circuit is configured to provide display data to the pixel circuits, and the sensing circuit does not sense the corresponding pixel circuit.

In an embodiment of the present invention, a method for sensing display panel is provided. The display panel includes a plurality of scan lines, a plurality of data lines and a plurality of pixel circuits. A data input terminal and a gate terminal of a corresponding pixel circuit of the pixel circuits are coupled to a corresponding data line of the data lines and a corresponding scan line of the scan lines respectively. The method includes the following steps. A sensing circuit senses characteristics of the pixel circuits according to a scan-line period for scanning one of the scan lines, wherein the scan-line period comprises display data period and a test data period. In the test data period within the scan-line period, the test data is provided to the pixel circuits, and the electrical characteristics of the corresponding pixel circuit is sensed. In the display data period within the same scan-line period, the display data is provided to the pixel circuits without sensing the corresponding pixel circuit.

Based on the above, the sensing apparatus and method in the embodiments of the present invention divide a scan-line period into at least a test data period and a display data period. In the test data period, the test data is written into a corresponding pixel circuit, and the sensing circuit senses the electrical characteristic (e.g., current or voltage) of the corresponding pixel circuit at the same time. In the display data period, the display data (pixel data) corresponding to the data lines is written into the corresponding pixel circuit, and the sensing circuit does not sense the corresponding pixel circuit at the same time. Accordingly, the sensing apparatus and method provided in the embodiment of the present invention can sense the electrical characteristic of the corresponding pixel circuit in a frame period in real time.

To make the above features and advantages of the present invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
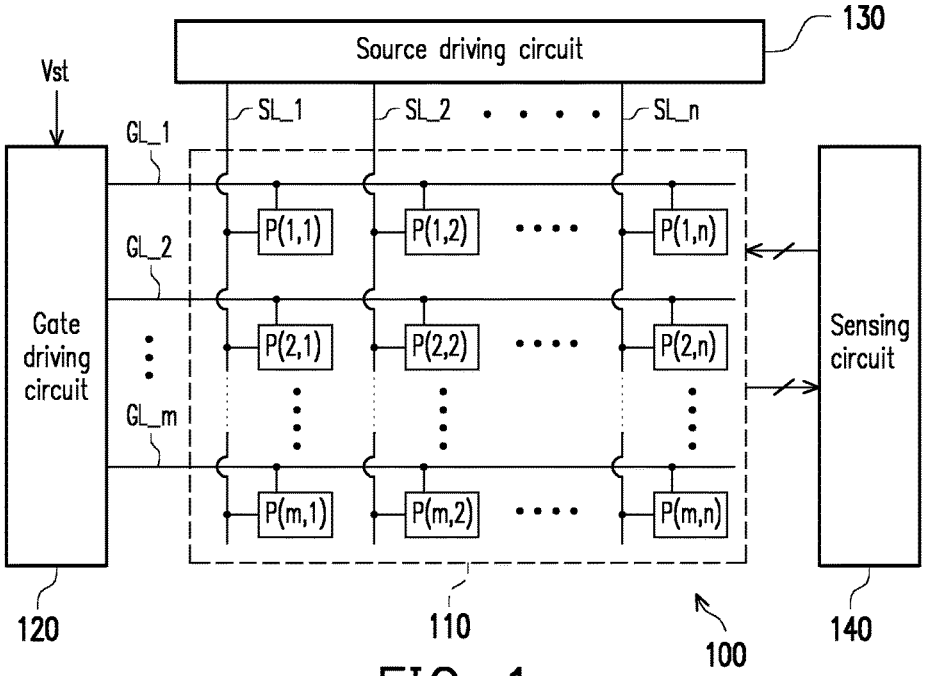
FIG. 1 is a schematic circuit block diagram of a display apparatus according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The term "coupling/coupled" used in this specification (including claims) of the disclosure may refer to any direct or indirect connection means. For example, "a first device is coupled to a second device" should be interpreted as "the first device is directly connected to the second device" or "the first device is indirectly connected to the second device through other devices or connection means." In addition, the term "signal" can refer to a current, a voltage, a charge, a temperature, data, electromagnetic wave or any one or multiple signals.

FIG. 1 is a schematic circuit block diagram of display apparatus 100 according to an embodiment of the present invention. Display apparatus 100 includes a display panel 110, a gate driving circuit 120, a source driving circuit 130 and a sensing circuit 140. One or more of the gate driving circuit 120, the source driving circuit 130 and the sensing circuit 140 can be integrated in some implementations. For example, the source driving circuit 130 and the sensing circuit 140 can be integrated into a chip. At least one of the gate driving circuit 120, source driving circuit 130, the sensing circuit 140 can be controlled by a timing controller (not shown). Display panel 110 includes a plurality of scan lines (e.g., GL_1, GL_2, . . . , GL_m of FIG. 1, m is an integer), a plurality of data lines (e.g., SL_1, SL_2, . . . , SL_n of FIG. 1, n is an integer) and a plurality of pixel circuits (e.g., P(1,1), P(1,2), . . . , P(1,n), P(2,1), P(2,2), . . . , P(2,n), . . . , P(m,1), P(m,2), . . . , P(m,n)). Display panel 110 may be an organic light emitting diode (OLED) display panel (e.g. an AMOLED display panel) or other types of display panel.

Data lines (also referred as source lines) SL_1 to SL_n cross scan lines (also referred as gate lines) GL_1 to GL_m, but data lines SL_1 to SL_n do not electrically contact scan lines GL_1 to GL_m. Pixel circuits P(1,1) to P(m,n) are distributed over display panel 110 in a matrix form. A data input terminal and a gate terminal of a corresponding pixel circuit of pixel circuits P(1,1) to P(m,n) are coupled to a corresponding data line of data lines SL_1 to SL_n and a corresponding scan line of scan lines GL_1 to GL_m respectively, as shown in FIG. 1.

A plurality of output terminals of gate driving circuit 120 are one-on-one coupled to scan lines GL_1 to GL_m. Gate driving circuit 120 may define a plurality of scan-line periods in a frame period. Gate driving circuit 120 may drive (or scan) every scan line GL_1 to GL_m of display panel 110 one after another in the scan-line periods, where a corresponding scan-line period within the scan-line periods corresponds to a scan line of the scan lines GL_1 to GL_m. Source driving circuit 130 may convert a plurality of digital pixel data into corresponding driving voltages (pixel voltages, also referred as display data). The source driving circuit 130 is coupled to the data lines SL_1 to SL_n to drive the pixel circuits P(1,1) to P(m,n) according to a scan-line period for scanning one of the scan lines GL_1 to GL_m. With the scan timing of gate driving circuit 120, source driving circuit 130 may write the corresponding pixel voltages (display data) into the respective corresponding pixel circuits of display panel 110 via data lines SL_1 to SL_n to display image.

The sensing apparatus includes source driving circuit 130 and sensing circuit 140. Sensing circuit 140 is coupled to pixel circuits P(1,1) to P(m,n). The characteristics of pixel circuits P(1,1) to P(m,n) are different from each other due to the effects of process variation and/or the aging rate differences between elements. Sensing circuit 140 can sense the characteristic of pixel circuits P(1,1) to P(m,n) in real time according to the scan-line period for scanning one of the scan lines GL_1 to GL_m, wherein the scan-line period comprises a display data period and a test data period. Sensing circuit 140 may provide the timing controller with sensing data indicative the characteristics of the pixel circuit.

Figure 2:
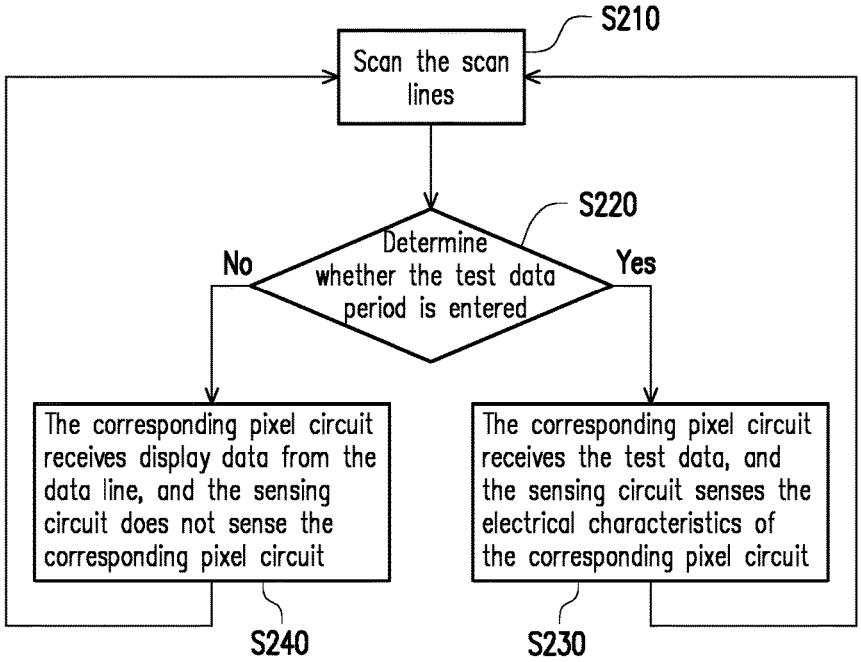
FIG. 2 is a schematic flow chart of a method for sensing display panel according to an embodiment of the present invention.

FIG. 2 is a schematic flow chart of a method for sensing display panel 110 according to an embodiment of the present invention. Referring to FIG. 1 and FIG. 2, Gate driving circuit 120 may define a plurality of scan-line periods in a frame period, and scan the scan lines GL_1 to GL_m in the scan-line periods (S210).

Figure 3:
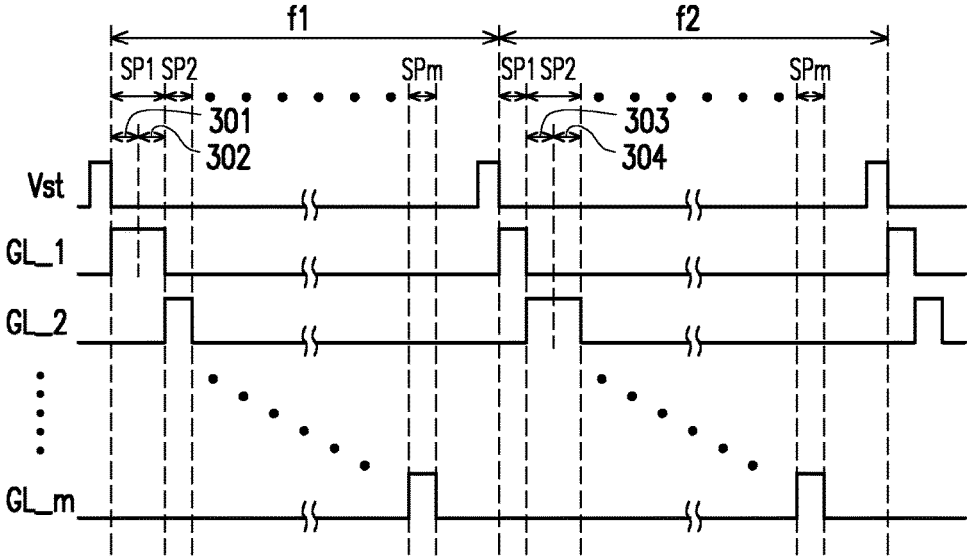
FIG. 3 is a schematic signal timing diagram of the circuit depicted in FIG. 1 according to an embodiment of the present invention.

FIG. 3 is a schematic signal timing diagram of the circuit depicted in FIG. 1 according to an embodiment of the present invention. Gate driving circuit 120 receives initial pulse Vst and generates a driving signal (scan signal) to scan lines GL_1 to GL_m, as shown in FIG. 3. Initial pulse Vst may define the frame periods. Gate driving circuit 120 may define a plurality of scan-line periods SP_1, SP_2, . . . , SP_m in a frame period f1. It can be deduced that gate driving circuit 120 may also define a plurality of scan-line periods SP_1, SP_2, . . . , SP_m in another frame period (e.g., frame period f2). According to the design requirements, one or more (even all) of scan-line periods SP_1 to SP_m can be selected (or defined or predetermined) in one frame period, where each selected scan-line period is further divided into a test data period and a display data period. Taking FIG. 3 as an example, scan-line period SP_1 is selected to perform detection in frame period f1, and the selected scan-line period SP_1 is further divided into test data period 301 and display data period 302. Scan-line period SP_2 is selected to perform detection in the next frame period f2, and the selected scan-line period SP_2 is further divided into test data period 303 and display data period 304.

Referring to FIG. 1 to FIG. 3, it can be determined whether test data period is entered in step S220. In test data period 301 within the corresponding scan-line period SP_1 of frame period f1, the source driving circuit 130 is configured to provide the test data to the pixel circuits, and the sensing circuit 140 may sense the electrical characteristics of the corresponding pixel circuits on scan line GL_1 (S230).

In display data period 302 within the same corresponding scan-line period SP_1 of frame period f1, the source driving circuit 130 is configured to provide display data to the pixel circuits, and the sensing circuit 140 does not sense the corresponding pixel circuits (S240). One of the source driving circuit 130 and the sensing circuit 140 is configured to control the pixel circuit to receive the display data or the test data. In frame period f1, the test data period does not exist in the not selected scan-line periods SP_2 to SP_m, therefore the corresponding pixel circuits on scan lines GL_2 to GL_m perform step S240 in scan-line periods SP_2 to SP_m.

The operations in test data period 303 and display data period 304 of frame period f2 can be deduced by referring to the related descriptions of test data period 301 and display data period 302, which is not repeated herein. According to the design requirements, periods 301 and 303 of FIG. 3 may be display data period, and periods 302 and 304 of FIG. 3 may be test data period.

The sensing apparatus and method in the present embodiment can divide a scan-line period into at least a test data period and a display data period. In the test data period, test data is written into the corresponding pixel circuits, and sensing circuit 140 senses the electrical characteristics (e.g., current or voltage) of the corresponding pixel circuits at the same time. In the display data period, display data (pixel data) corresponding to the data lines is written into the corresponding pixel circuits, and sensing circuit 140 does not sense the corresponding pixel circuits at the same time. Accordingly, the sensing apparatus and method provided in the present embodiment can sense the electrical characteristics of the corresponding pixel circuits in a frame period in real time. After obtaining the corresponding relation between the electrical characteristics and the test data of the corresponding pixel circuits, a compensation circuit (not shown) may further compensate the corresponding pixel circuits according to the corresponding relation. The compensation circuit (not shown) may be a conventional compensation mechanism/approach, therefore which is not repeated herein.

Figure 4:
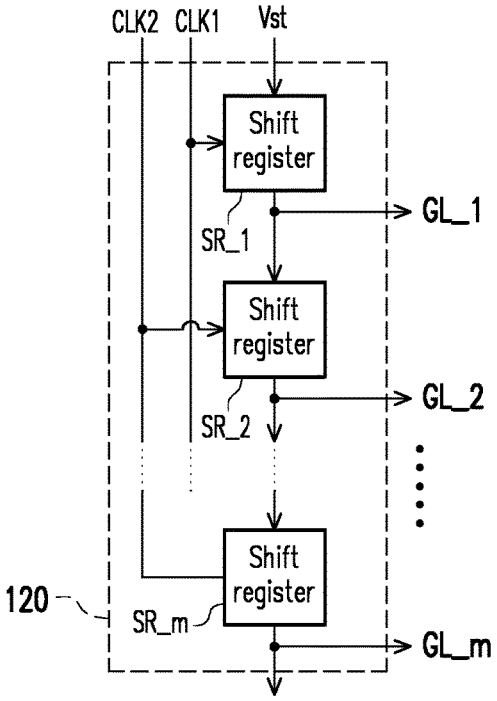
FIG. 4 is a schematic circuit block diagram of the gate driving circuit depicted in FIG. 1 according to an embodiment of the present invention.

FIG. 4 is a schematic circuit block diagram of gate driving circuit 120 depicted in FIG. 1 according to an embodiment of the present invention. Gate driving circuit 120 includes a plurality of shift registers SR_1, SR_2, . . . , SR_m. These shift registers SR_1 to SR_m are series-connected to one another and forms a shift register string. A plurality of output terminals of shift registers SR_1 to SR_m are one-on-one coupled to scan lines GL_1 to GL_m, as shown in FIG. 4. According to the trigger timing of clock signals CLK1 and CLK2, initial pulse Vst may be transmitted from shift register SR_1 to shift register SR_m.

Figure 5:
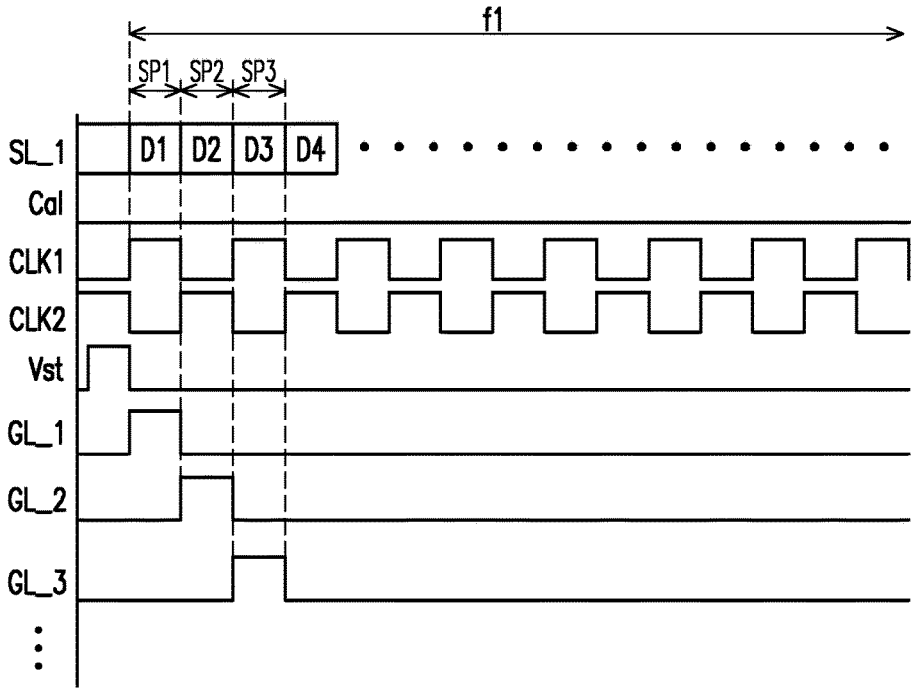
FIG. 5 is a schematic signal timing diagram of the circuit depicted in FIG. 4 according to an embodiment of the present invention.

FIG. 5 is a schematic signal timing diagram of the circuit depicted in FIG. 4 according to an embodiment of the present invention. Shift register SR_1 receives initial pulse Vst, and initial pulse Vst may be transmitted from shift register SR_1 to shift register SR_m, as the pulses of scan lines GL_1 to GL_3 of FIG. 5. Initial pulse Vst may define frame period f1. According to the trigger timing of clock signals CLK1 and CLK2, gate driving circuit 120 may define a plurality of scan-line periods in frame period f1, as scan line periods SP_1, SP_2 and SP_3 of FIG. 5. Accordingly, shift registers SR_1 to SR_m may drive (or scan) every scan line GL_1 to GL_m of display panel 110 one after another in the scan-line periods. With the scan timing of shift registers SR_1 to SR_m, source driving circuit 130 may write display data (e.g., display data D1, D2, D3, D4, . . . of FIG. 5) into the corresponding pixel circuits P(1,1), P(2,1), . . . , P(m,1) of display panel 110 via data line SL_1.

Figure 6:
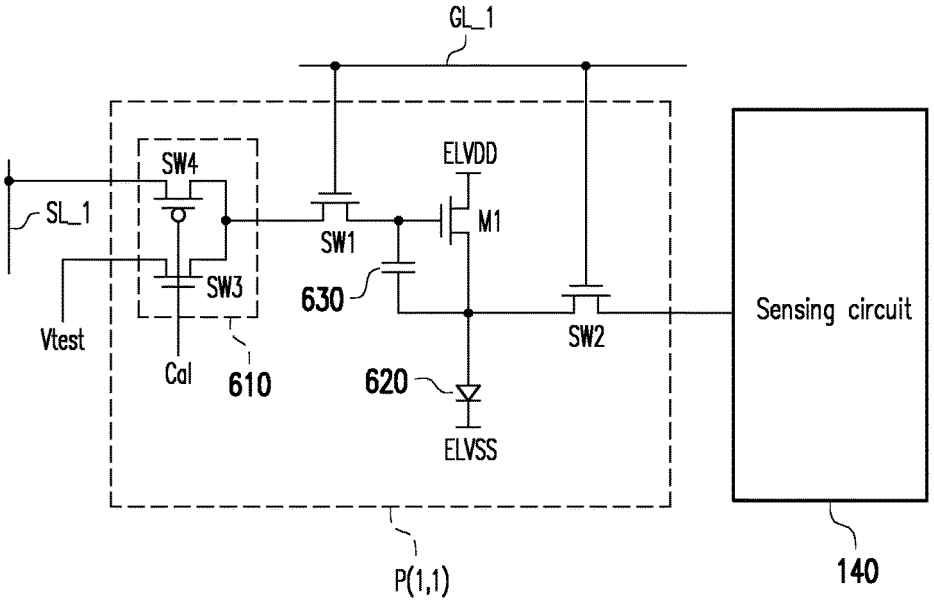
FIG. 6 is a schematic circuit block diagram of the pixel circuit depicted in FIG. 1 according to an embodiment of the present invention.
Figure 7:
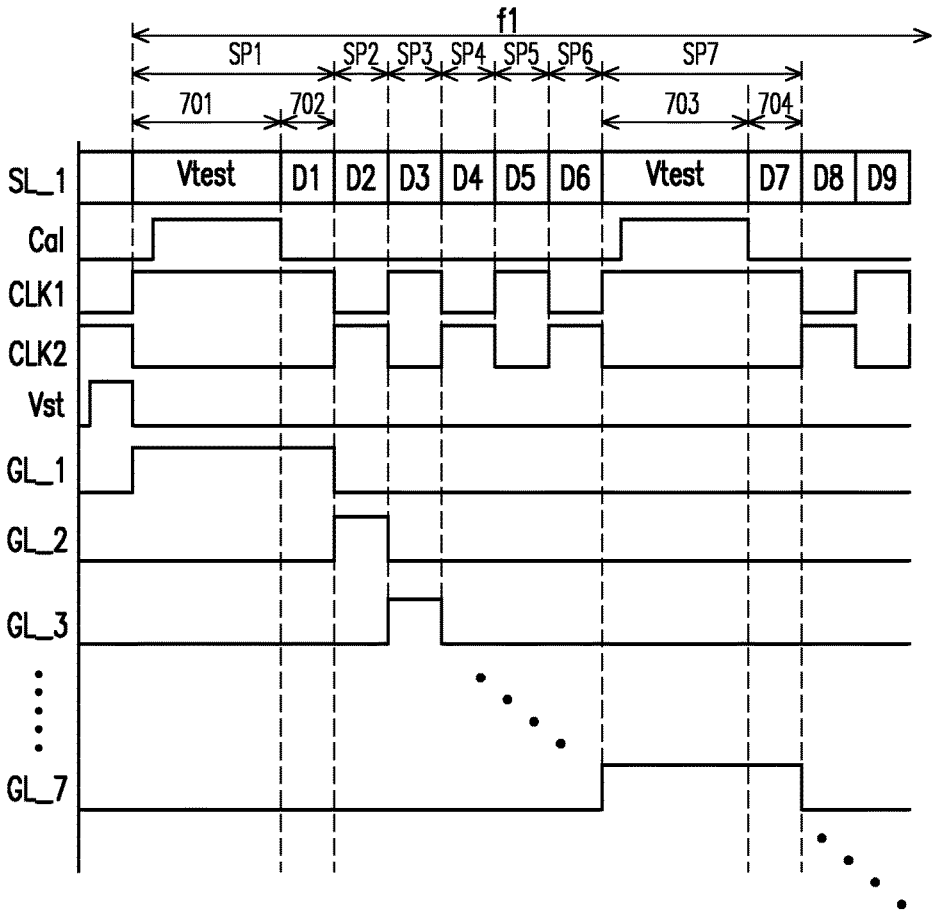
FIG. 7 is a schematic signal timing diagram of the circuit depicted in FIG. 4 and FIG. 6 according to an embodiment of the present invention.

FIG. 6 is a schematic circuit block diagram of pixel circuit P(1,1) depicted in FIG. 1 according to an embodiment of the present invention. FIG. 7 is a schematic signal timing diagram of the circuit depicted in FIG. 4 and FIG. 6 according to an embodiment of the present invention. Gate driving circuit 120 of FIG. 4 receives initial pulse Vst. According to the trigger timing of clock signals CLK1 and CLK2, gate driving circuit 120 of FIG. 4 generates scan signals as shown in FIG. 7 to scan lines GL_1, GL_2, GL_3, . . . , GL_7, . . . , GL_m. With the scan timing of scan lines GL_1 to GL_m, source driving circuit 130 may write display data (e.g., display data D1, D2, D3, D4, D5, D6, D7, D8, D9 of FIG. 7) into the corresponding pixel circuits P(1,1), P(2,1), . . . , P(m,1) of display panel 110 via data line SL_1.

According to the trigger timing of clock signals CLK1 and CLK2, gate driving circuit 120 may define a plurality of scan-line periods in frame period f1, such as scan line periods SP_1, SP_2, SP_3, SP_4, SP_5, SP_6, SP_7 of FIG. 7. In the embodiment of FIG. 7, scan-line periods SP_1 and SP_7 are selected in frame period f1. The selected scan-line period SP_1 is further divided into test data period 701 and display data period 702, and the selected scan-line period SP_7 is further divided into test data period 703 and display data period 704.

The implementation details of other pixel circuits of FIG. 1 can be deduced by referring to the related descriptions of pixel circuit P(1,1) of FIG. 6, therefore which is not repeated herein. Pixel circuit P(1,1) of FIG. 6 includes switch circuit 610, first switch SW1, second switch SW2, transistor M1, organic light emitting diode (OLED) 620 and storage capacitor 630. The switch circuit 610 is coupled to the corresponding pixel circuit. The switch circuit 610 controls whether the display data or the test data is provided to the corresponding pixel circuit. A first input terminal of switch circuit 610 is coupled to sensing circuit 140 to receive test data Vtest. A second input terminal of switch circuit 610 is coupled to the corresponding data line SL_1 to receive display data. An output terminal of switch circuit 610 is coupled to a first terminal of first switch SW1. Switch circuit 610 is controlled by correction signal Cal. According to the control of correction signal Cal, test data Vtest of the first input terminal of switch circuit 610 is transmitted to the first terminal of first switch SW1 in the test data period, and display data of the second input terminal of switch circuit 610 is transmitted to the first terminal of first switch SW1 in the display data period. It is noted that it is not necessary to dispose a respective switch circuit for each pixel circuit on the same data line. For example, a switch circuit 610 can be coupled between the source driving circuit and one row of pixel units. In addition, the switch circuit 610 can be within the pixel circuit on the display panel. Alternatively, the switch circuit 610 can be disposed outside the pixel circuit 6. For example, it can be disposed in either the source driving circuit 130 or the sensing circuit 140. An output terminal of the switch circuit 610 is coupled to a data terminal of the corresponding pixel circuit. The switch circuit 610 controls the display data or the test data is provided to the corresponding pixel circuit. A first input terminal of the switch circuit 610 is configured to transmit test data to the data terminal of the corresponding pixel circuit in the test data period. A second input terminal of the switch circuit 610 is configured to transmit display data to the data terminal of the corresponding pixel circuit in the display data period.

In the embodiment of FIG. 6, switch circuit 610 includes third switch SW3 and fourth switch SW4. A control terminal of third switch SW3 is controlled by correction signal Cal. A first terminal of third switch SW3 receives test data Vtest. A second terminal of third switch SW3 is coupled to the data terminal of the pixel circuit, e.g., the second terminal of third switch SW3 is coupled to the first terminal of first switch SW1. A control terminal of fourth switch SW4 is controlled by correction signal Cal. The correction signal may be generated by any circuit according to design requirement. In other words, it can be generated by at least one of the source driving circuit 130 and the sensing circuit 140, the gate driving circuit 120, and the timing controller. A first terminal of fourth switch SW4 is coupled to the corresponding data line SL_1 to receive display data. A second terminal of fourth switch SW4 is coupled to the data terminal of the pixel circuit, e.g., the second terminal of fourth switch SW4 is coupled to the first terminal of first switch SW1. According to the control of correction signal Cal, third switch SW3 is turned on and fourth switch SW4 is turned off in the test data period, and third switch SW3 is turned off and fourth switch SW4 is turned on in the display data period.

A control terminal of first switch SW1 is coupled to the corresponding scan line GL_1. A control terminal (e.g., gate) of transistor M1 is coupled to a second terminal of first switch SW1. A first terminal (e.g., drain) of transistor M1 is coupled to a first voltage ELVDD. A first terminal (e.g., anode) of OLED 620 is coupled to a second terminal (e.g., source) of transistor M1. A second terminal (e.g., cathode) of OLED 620 is coupled to a second voltage ELVSS. The levels of first voltage ELVDD and second voltage ELVSS can be determined according to design requirements.

A first terminal of second switch SW2 is coupled to a second terminal of transistor M1 and the first terminal of OLED 620. A second terminal of second switch SW2 is coupled to sensing circuit 140. In the embodiment of FIG. 6, the control terminal of first switch SW1 and the control terminal of second switch SW2 are coupled to the corresponding scan line GL_1, so that first switch SW1 and second switch SW2 are turned on in test data period 701 and display data period 702.

A first terminal and a second terminal of storage capacitor 630 are coupled to the control terminal and the second terminal of transistor M1 respectively. Transistor M1 may convert the voltage of storage capacitor 630 into the driving current. The driving current flows through OLED 620 to light up OLED 620. Accordingly, by setting the voltage of storage capacitor 630, the luminance (or gray scale) of OLED 620 can be correspondingly adjusted.

In test data period 701, test data Vtest is written into storage capacitor 630 of the corresponding pixel circuit P(1,1), and sensing circuit 140 senses the electrical characteristic of pixel circuit P(1,1) at the same time. For example (but not limited to), sensing circuit 140 may provide a DC bias to the anode of OLED 620 via second switch SW2, and measure the current volume flowing through transistor M1. According to the design requirements, the level of the DC bias may be equal or approximate to the level of second voltage ELVSS, so that OLED 620 can be cutoff. Accordingly, sensing circuit 140 may obtain the corresponding relation (the electrical characteristic of pixel circuit P(1,1)) between test data Vtest and the current volume flowing through transistor M1. Otherwise, sensing circuit 140 may provide another DC bias to the anode of OLED 620 via second switch SW2, and measure the current volume flowing through OLED 620. According to the design requirements, the level of said another DC bias may be equal or approximate to the level of test data Vtest, so that transistor M1 can be cutoff. Accordingly, sensing circuit 140 may obtain the corresponding relation (the electrical characteristic of pixel circuit P(1,1)) between test data Vtest and the current volume flowing through OLED 620. The present embodiment does not limit the sensing method of sensing circuit 140. For example (but not limited to), the method for sensing electrical characteristic of pixel circuit P(1,1) by sensing circuit 140 may be a conventional sensing method.

In display data period 702, display data (pixel data) corresponding to data line SL_1 is written into storage capacitor 630 of the corresponding pixel circuit P(1,1), and sensing circuit 140 does not sense the corresponding pixel circuit P(1,1) at the same time. Accordingly, sensing circuit 140 can sense the electrical characteristic of the corresponding pixel circuit P(1,1) in frame period f1 in real time.

Figure 8:
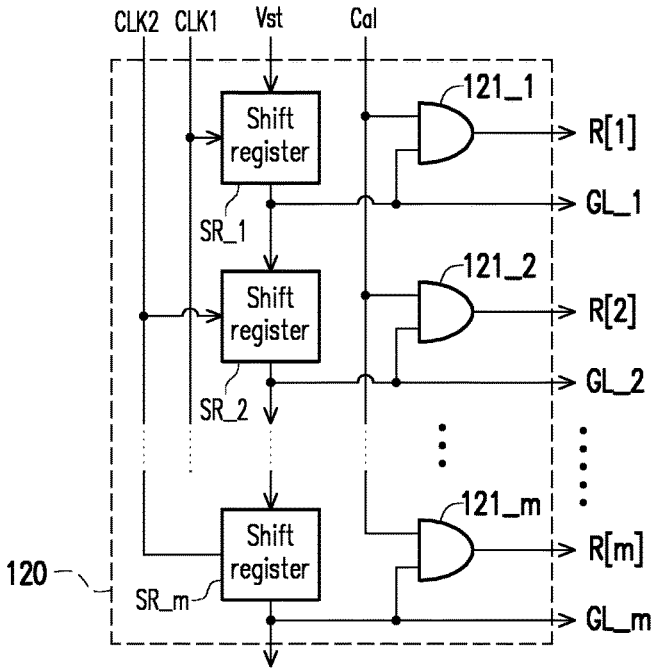
FIG. 8 is a schematic circuit block diagram of the gate driving circuit depicted in FIG. 1 according to another embodiment of the present invention.

FIG. 8 is a schematic circuit block diagram of gate driving circuit 120 depicted in FIG. 1 according to another embodiment of the present invention. In the embodiment of FIG. 8, Gate driving circuit 120 includes a plurality of shift registers SR_1, SR_2, . . . , SR_m and a plurality of AND gates 121_1, 121_2, . . . , **121_*m*. These shift registers SR_1 to SR_m of FIG. 8 can be referred to the related descriptions of shift registers SR_1 to SR_m of FIG. 4, therefore which is not repeated herein. First input terminals of AND gates 121_1 to 121_*m* of FIG. 8 receive correction signal Cal. Second input terminals of AND gates 121_1 to 121_*m* are one-to-one coupled to output terminals of shift registers SR_1 to SR_m. Output terminals of AND gates 121_1 to 121_*m* may provide control signals R[1], R[2], . . . , R[m] to pixel circuits P(1,1) to P(m,n) of display panel 110**.

Figure 9:
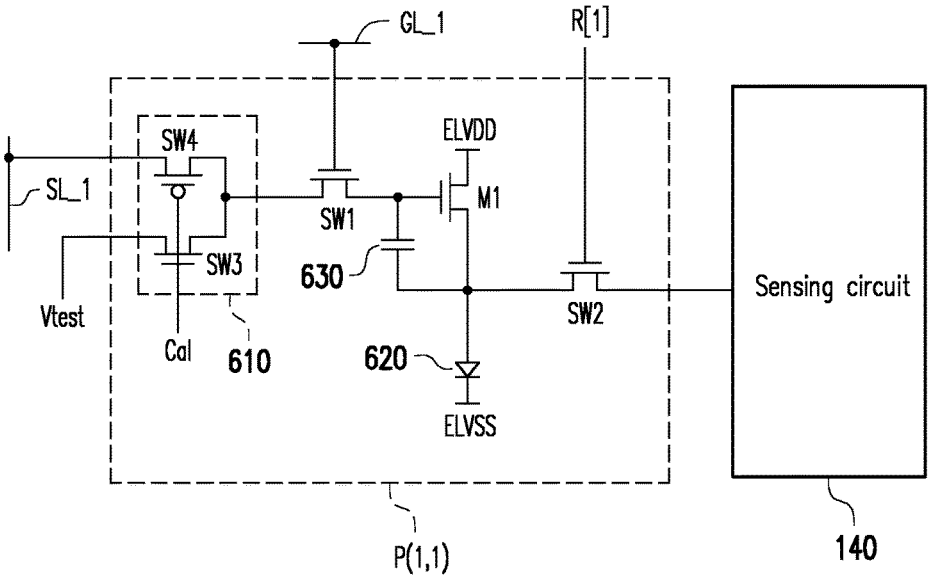
FIG. 9 is a schematic circuit block diagram of the pixel circuit depicted in FIG. 1 according to another embodiment of the present invention.
Figure 10:
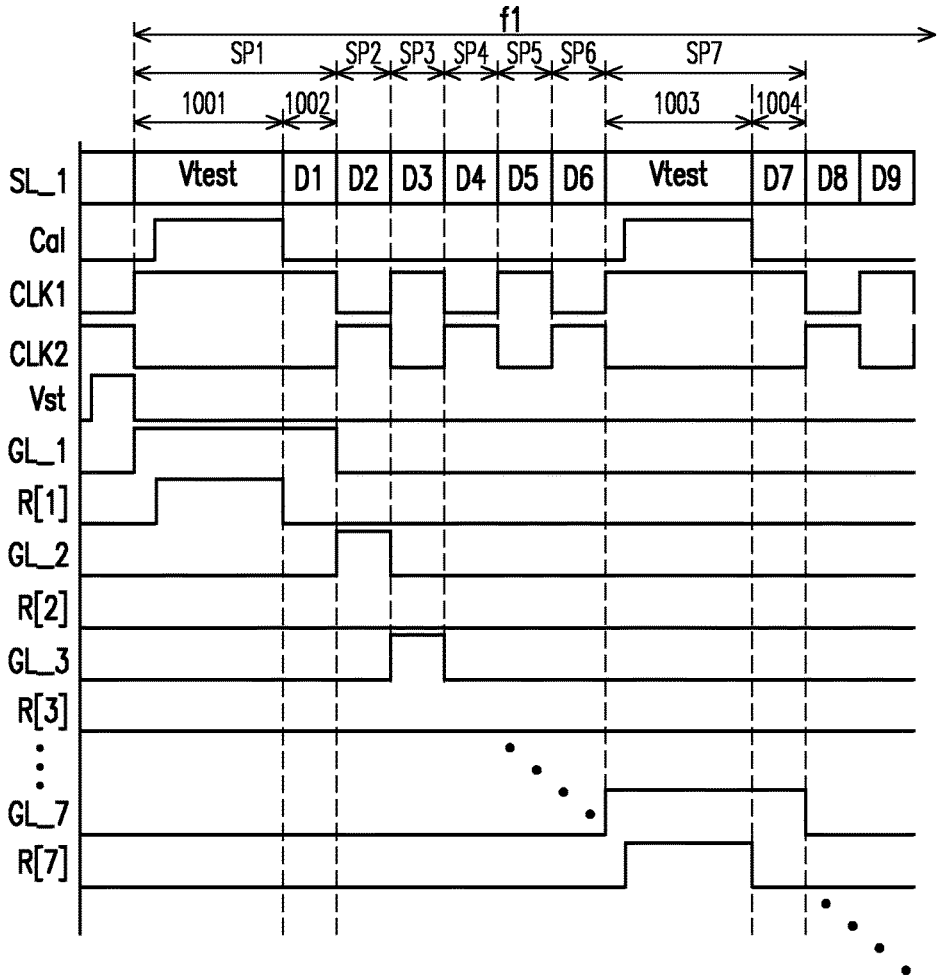
FIG. 10 is a schematic signal timing diagram of the circuit depicted in FIG. 8 and FIG. 9 according to an embodiment of the present invention.

FIG. 9 is a schematic circuit block diagram of pixel circuit P(1,1) depicted in FIG. 1 according to another embodiment of the present invention. FIG. 10 is a schematic signal timing diagram of the circuit depicted in FIG. 8 and FIG. 9 according to an embodiment of the present invention. Gate driving circuit 120 of FIG. 8 receives initial pulse Vst. According to the trigger timing of clock signals CLK1 and CLK2, gate driving circuit 120 of FIG. 8 generates scan signals as shown in FIG. 10 to scan lines GL_1, GL_2, GL_3, . . . , GL_7, . . . , GL_m. With the scan timing of scan lines GL_1 to GL_m, source driving circuit 130 may write display data (e.g., display data D1, D2, D3, D4, D5, D6, D7, D8, D9 of FIG. 10) into the corresponding pixel circuits P(1,1), P(2,1), . . . , P(m,1) of display panel 110 via data line SL_1.

According to the trigger timing of clock signals CLK1 and CLK2, gate driving circuit 120 may define a plurality of scan-line periods in frame period f1, such as scan line periods SP_1, SP_2, SP_3, SP_4, SP_5, SP_6, SP_7 of FIG. 10. In the embodiment of FIG. 10, scan-line periods SP_1 and SP_7 are selected to perform detection in frame period f1. The selected scan-line period SP_1 is further divided into test data period 1001 and display data period 1002, and the selected scan-line period SP_7 is further divided into test data period 1003 and display data period 1004.

The implementation details of other pixel circuits of FIG. 1 can be deduced by referring to the related descriptions of pixel circuit P(1,1) of FIG. 9, therefore which is not repeated herein. Pixel circuit P(1,1) of FIG. 9 includes switch circuit 610, first switch SW1, second switch SW2, transistor M1, OLED 620 and storage capacitor 630. Switch circuit 610, first switch SW1, second switch SW2, transistor M1, OLED 620 and storage capacitor 630 of FIG. 9 can be deduced by referring to the related descriptions of FIG. 6, therefore which is not repeated herein. The difference between these two embodiments of FIG. 6 and FIG. 9 is that in the embodiment of FIG. 9, the control terminal of second switch SW2 of pixel circuit P(1,1) is coupled to a output terminal of a corresponding AND gate (e.g., AND gate 121_1) of the AND gates 121_1 to 121_*m* to receive control signal R[1].

In test data period 1001, first switch SW1 and second switch SW2 are both turned on. Accordingly, test data Vtest is written into storage capacitor 630 of the corresponding pixel circuit P(1,1), and sensing circuit 140 senses the electrical characteristic of pixel circuit P(1,1) at the same time. The method for sensing pixel circuit P(1,1) by sensing circuit 140 of FIG. 9 can be deduced by referring to the related descriptions of sensing circuit 140 of FIG. 6, therefore which is not repeated herein.

In display data period 1002, first switch SW1 is turned on and second switch SW2 is turned off. Accordingly, display data (pixel data) corresponding to data line SL_1 is written into storage capacitor 630 of the corresponding pixel circuit P(1,1), and sensing circuit 140 does not sense the corresponding pixel circuit P(1,1) at the same time. Accordingly, sensing circuit 140 can sense the electrical characteristic of the corresponding pixel circuit P(1,1) in frame period f1 in real time.

Figure 11:
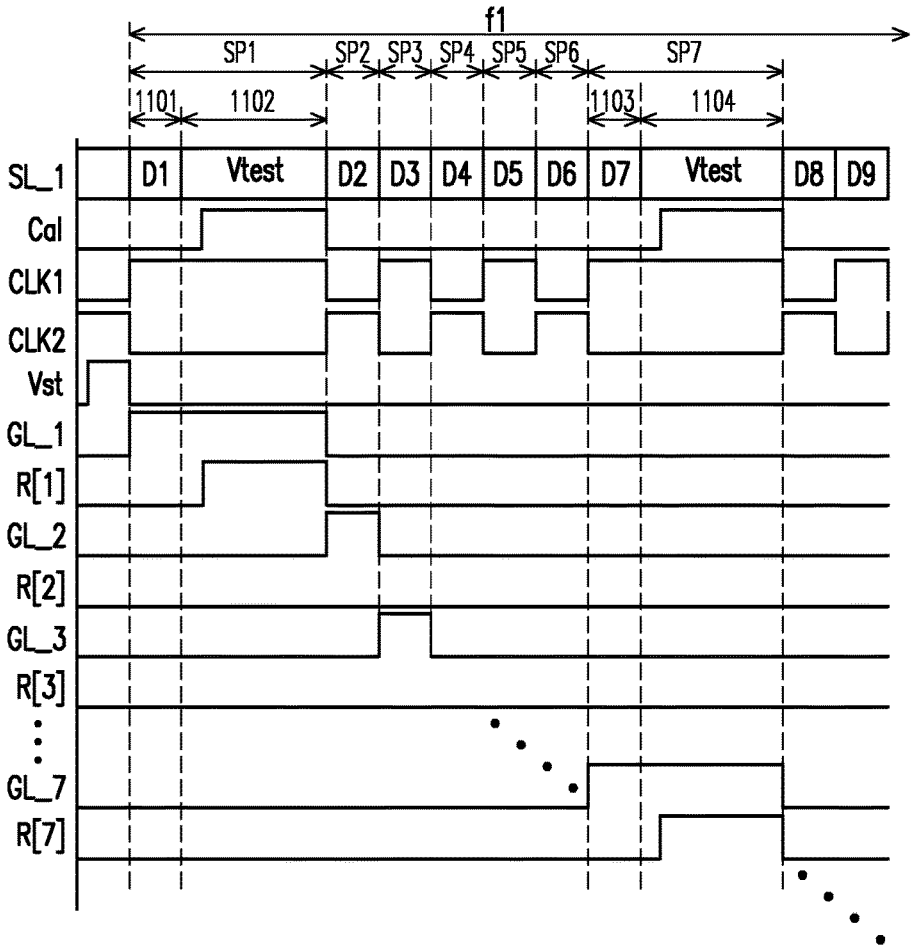
FIG. 11 is a schematic signal timing diagram of the circuit depicted in FIG. 8 and FIG. 9 according to another embodiment of the present invention.

In the embodiment of FIG. 10, test data period 1001 is preceding to display data period 1002. In other embodiments, test data period 1001 may be succeeding to display data period 1002. For example, FIG. 11 is a schematic signal timing diagram of the circuit depicted in FIG. 8 and FIG. 9 according to another embodiment of the present invention. According to the trigger timing of clock signals CLK1 and CLK2, gate driving circuit 120 of FIG. 8 generates scan signals as shown in FIG. 11 to scan lines GL_1, GL_2, GL_3, . . . , GL_7, . . . , GL_m. With the scan timing of scan lines GL_1 to GL_m, source driving circuit 130 may write display data (e.g., display data D1, D2, D3, D4, D5, D6, D7, D8, D9 of FIG. 11) into the corresponding pixel circuits P(1,1), P(2,1), . . . , P(m,1) of display panel 110 via data line SL_1. According to the trigger timing of clock signals CLK1 and CLK2, gate driving circuit 120 may define a plurality of scan-line periods in frame period f1, such as scan line periods SP_1, SP_2, SP_3, SP_4, SP_5, SP_6, SP_7 of FIG. 11. In the embodiment of FIG. 11, scan-line periods SP_1 and SP_7 are selected to perform detection in frame period f1. The selected scan-line period SP_1 is further divided into display data period 1101 and test data period 1102, and the selected scan-line period SP_7 is further divided into display data period 1103 and test data period 1104.

In display data period 1101, first switch SW1 is turned on and second switch SW2 is turned off. Accordingly, display data (pixel data) corresponding to data line SL_1 is written into storage capacitor 630 of the corresponding pixel circuit P(1,1), and sensing circuit 140 does not sense the corresponding pixel circuit P(1,1) at the same time. In test data period 1102, first switch SW1 and second switch SW2 are both turned on. Accordingly, test data Vtest is written into storage capacitor 630 of the corresponding pixel circuit P(1,1), and sensing circuit 140 senses the electrical characteristic of pixel circuit P(1,1) at the same time. Accordingly, sensing circuit 140 can sense the electrical characteristic of the corresponding pixel circuit P(1,1) in frame period f1 in real time.

Figure 12:
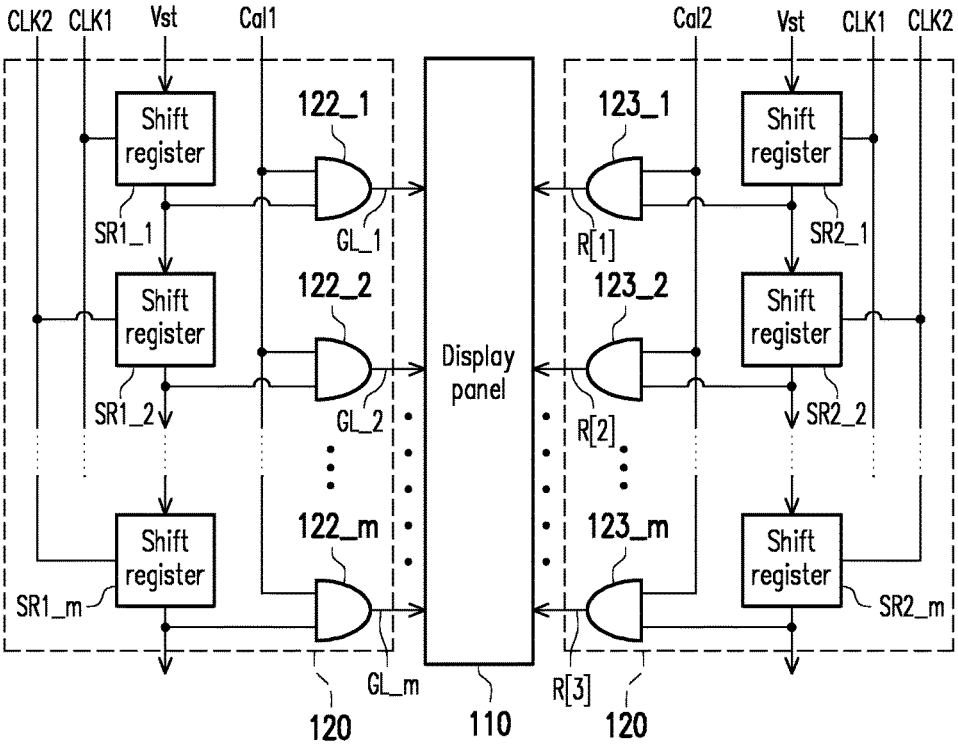
FIG. 12 is a schematic circuit block diagram of the gate driving circuit depicted in FIG. 1 according to another embodiment of the present invention.

FIG. 12 is a schematic circuit block diagram of the gate driving circuit depicted in FIG. 1 according to another embodiment of the present invention. In the embodiment of FIG. 12, Gate driving circuit 120 includes a plurality of first shift registers (e.g., SR1_1, SR1_2, . . . , SR1_*m* of FIG. 12), a plurality of second shift registers (e.g., SR2_1, SR2_2, . . . , SR2_*m* of FIG. 12), a plurality of first AND gates (e.g., 122_1, 122_2, . . . , 122_*m* of FIG. 12), a plurality of second AND gates (e.g., 123_1, 123_2, . . . , 123_*m* of FIG. 12). These first shift registers SR1_1 to SR1_*m* and second shift registers SR2_1 to SR2_*m* of FIG. 12 can be deduced by referring to the related descriptions of shift registers SR_1 to SR_m of FIG. 4, therefore which is not repeated herein. First input terminals of first AND gates 122_1 to 122_*m* of FIG. 12 receive first correction signal Cal1. Second input terminals of first AND gates 122_1 to 122_*m* are one-to-one coupled to output terminals of first shift registers SR1_1 to SR1_*m*. A plurality of output terminals of first AND gates 122_1 to 122_*m* are one-on-one coupled to scan lines GL_1 to GL_m of display panel 110, to provide the scan signal. First input terminals of second AND gates 123_1 to 123_*m* receive second correction signal Cal1. Second input terminals of second AND gates 123_1 to 123_*m* are one-to-one coupled to output terminals of second shift registers SR2_1 to SR2_*m*. Output terminals of second AND gates 123_1 to 123_*m* may provide control signals R[1], R[2], . . . , R[m] to pixel circuits P(1,1) to P(m,n) of display panel 110.

Figure 13:
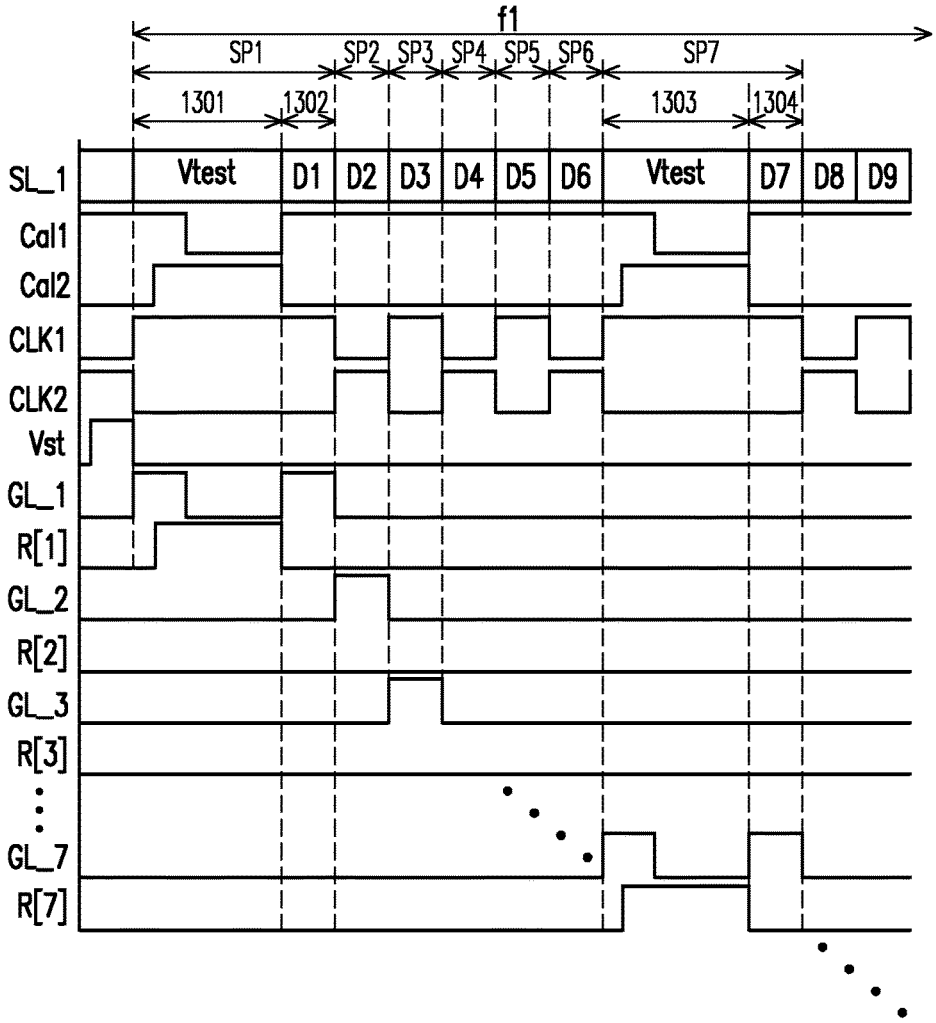
FIG. 13 is a schematic signal timing diagram of the circuit depicted in FIG. 9 and FIG. 12 according to an embodiment of the present invention.

Pixel circuit P(1,1) of FIG. 9 can be applied to display panel 110 of FIG. 12, and second correction signal Cal2 of FIG. 12 can be taken as correction signal Cal of FIG. 9. An output terminal of a corresponding second AND gate 123_1 of the second AND gates 123_1 to 123_*m* is coupled to a control terminal of second switch SW2 of the corresponding pixel circuit P(1,1) of FIG. 9. FIG. 13 is a schematic signal timing diagram of the circuit depicted in FIG. 9 and FIG. 12 according to an embodiment of the present invention. According to the trigger timing of clock signals CLK1 and CLK2, gate driving circuit 120 may define a plurality of scan-line periods in frame period f1, such as scan line periods SP_1, SP_2, SP_3, SP_4, SP_5, SP_6, SP_7 of FIG. 13. In the embodiment of FIG. 13, scan-line periods SP_1 and SP_7 are selected to perform detection in frame period f1. The selected scan-line period SP_1 is further divided into test data period 1301 and display data period 1302, and the selected scan-line period SP_7 is further divided into test data period 1303 and display data period 1304.

Gate driving circuit 120 of FIG. 12 receives initial pulse Vst. According to the trigger timing of clock signals CLK1 and CLK2, gate driving circuit 120 of FIG. 12 generates scan signals as shown in FIG. 13 to scan lines GL_1, GL_2, GL_3, . . . , GL_7, . . . , GL_m. With the scan timing of scan lines GL_1 to GL_m, source driving circuit 130 may write display data (e.g., display data D1, D2, D3, D4, D5, D6, D7, D8, D9 of FIG. 13) into the corresponding pixel circuits P(1,1), P(2,1), . . . , P(m,1) of display panel 110 via data line SL_1.

First correction signal Cal1 masks a part of pulse width of the signal of scan line GL_1 in test data period 1301, and first correction signal Cal1 masks a part of pulse width of the signal of scan line GL_7 in test data period 1303. Therefore, first switch SW1 and second switch SW2 of FIG. 9 are both turned on in a first sub-period of test data period 1301 (or 1303), and first switch SW1 is turned off and second switch SW2 is turned on in a second sub-period of test data period 1301 (or 1303). When first switch SW1 and second switch SW2 are both turned on, test data Vtest is written into storage capacitor 630 of the corresponding pixel circuit P(1,1), and sensing circuit 140 senses the electrical characteristic of pixel circuit P(1,1) at the same time. When first switch SW1 is turned off and second switch SW2 is turned on, the voltage of storage capacitor 630 of FIG. 9 is not affected by test data Vtest, and sensing circuit 140 may sense the electrical characteristic of pixel circuit P(1,1) at the same time. In display data period 1302 (or 1304), first switch SW1 is turned on and second switch SW2 is turned off. Accordingly, display data (pixel data) corresponding to data line SL_1 is written into storage capacitor 630 of the corresponding pixel circuit P(1,1), and sensing circuit 140 does not sense the corresponding pixel circuit P(1,1) at the same time.

It should be noted that, according to different application scenarios, gate driving circuit 120, source driving circuit 130 and/or sensing circuit 140 may be implemented as software, firmware or hardware by using general programming languages (e.g., C or C++), hardware description languages (e.g., Verilog HDL or VHDL) or other appropriate programming languages. Software (or firmware) capable of performing related functions may be configured as any known computer-accessible medias, such as magnetic tapes, semiconductor memories, magnetic disks or compact disks (e.g., CD-ROM or DVD-ROM). Otherwise, the software (or firmware) may be transmitted via Internet, wired communication, wireless communication or other communication medias. These software (or firmware) may be stored in the computer-accessible medias, so that the processor of the computer may access/execute the programming codes of the software (or firmware). Besides, the apparatus and method of the invention may be implemented by a combination of hardware and software.

In summary, the sensing apparatus and method in the embodiments of the present invention can divide a scan-line period into at least a test data period and a display data period. In the test data period, test data Vtest is written into a corresponding pixel circuit, and the sensing circuit senses the electrical characteristic (e.g., current or voltage) of the corresponding pixel circuit at the same time. In the display data period, display data (pixel data) corresponding to the data lines is written into the corresponding pixel circuit, and the sensing circuit does not sense the corresponding pixel circuit at the same time. Accordingly, the sensing apparatus and method provided in the embodiment of the present invention can sense the electrical characteristic of the corresponding pixel circuit in a frame period in real time. After obtaining the corresponding relation between the electrical characteristics and the test data of the corresponding pixel circuits, a compensation circuit (not shown) may further compensate the corresponding pixel circuits according to the corresponding relation. The compensation circuit (not shown) may be a conventional compensation mechanism/approach, therefore which is not repeated herein.

Although the invention has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. An apparatus for sensing a display panel, wherein the display panel comprises a plurality of scan lines, a plurality of data lines and a plurality of pixel circuits, a data input terminal and a gate terminal of a corresponding pixel circuit of the pixel circuits are coupled to a corresponding data line of the data lines and a corresponding scan line of the scan lines respectively, and the apparatus comprises:

a source driving circuit configured to be coupled to the data lines to drive the pixel circuits according to a scan-line period for scanning one of the scan lines; and a sensing circuit, configured to be coupled to the pixel circuits, and configured to sense characteristics of the pixel circuits according to the scan-line period for scanning one of the scan lines, wherein the scan-line period comprises a display data period and a test data period;

wherein in the test data period within the scan-line period, the source driving circuit is configured to provide test data to the pixel circuits, and the sensing circuit senses an electrical characteristic of the corresponding pixel circuit; and wherein in the display data period within the same scan-line period, the source driving circuit is configured to provide display data to the pixel circuits, and the sensing circuit does not sense the corresponding pixel circuit.

2. The apparatus as claimed in claim 1, wherein one of the source driving circuit and the sensing circuit is configured to control the pixel circuit to receive the display data or the test data.

3. The apparatus as claimed in claim 1, further comprising:

a switch circuit, coupled to the corresponding pixel circuit, configured to control whether the display data or the test data is provided to the corresponding pixel circuit.

4. The apparatus as claimed in claim 3, wherein the switch circuit comprises an output terminal coupled to a data terminal of the corresponding pixel circuit, a first input terminal of the switch circuit is configured to transmit test data to the data terminal of the corresponding pixel circuit in the test data period, and a second input terminal of the switch circuit is configured to transmit display data to the data terminal of the corresponding pixel circuit in the display data period.

5. The apparatus as claimed in claim 3, wherein the switch circuit comprises:

a first switch, wherein a control terminal of the first switch is controlled by a correction signal, a first terminal of the first switch configured to receive the test data, and a second terminal of the first switch is coupled to a data terminal of the corresponding pixel circuit; and a second switch, wherein a control terminal of the second switch is controlled by a correction signal, a first terminal of the second switch is coupled to the corresponding data line to receive the display data, and a second terminal of the second switch is coupled to the data terminal of the corresponding pixel circuit.

6. The apparatus as claimed in claim 3, wherein the first switch is turned on and the second switch is turned off in the test data period, and the first switch is turned off and the second switch is turned on in the display data period.

7. The apparatus as claimed in claim 3, wherein the switch circuit is disposed in the source driving circuit.

8. The apparatus as claimed in claim 3, wherein the switch circuit is disposed in the sensing circuit.

9. The apparatus as claimed in claim 3, wherein the switch circuit is disposed in the pixel circuit.

10. The apparatus as claimed in claim 1, wherein the display panel is an organic light emitting diode (OLED) display panel.

11. The apparatus as claimed in claim 1, further comprising:

a gate driving circuit configured to be coupled to the scan lines, and configured to define a plurality of scan-line periods in a frame period to scan the scan lines, wherein the scan-line period within the scan-line periods corresponds to one corresponding scan line of the scan lines.

12. The apparatus as claimed in claim 11, wherein the gate driving circuit comprises:

a plurality of first shift registers series-connected to one another.

13. The apparatus as claimed in claim 12, wherein the gate driving circuit further comprises:

a plurality of first AND gates, wherein a plurality of first input terminals of the first AND gates receive a first correction signal, a plurality of second input terminals of the first AND gates are one-to-one coupled to the output terminals of the first shift registers, and an output terminal of a corresponding first AND gate of the first AND gates is coupled to a control terminal of the pixel circuit.

14. The apparatus as claimed in claim 13, wherein the gate driving circuit further comprises:

a plurality of second shift registers series-connected to one another; and a plurality of second AND gates, wherein a plurality of first input terminals of the second AND gates receive a second correction signal, a plurality of second input terminals of the second AND gates are one-to-one coupled to a plurality of output terminals of the second shift registers, and a plurality of output terminals of the second AND gates are one-on-one coupled to the scan lines.

15. The apparatus as claimed in claim 1, wherein the corresponding pixel circuit comprises:

a first switch, wherein a control terminal of the first switch is coupled to the corresponding scan line;

a transistor, wherein a control terminal of the transistor is coupled to a second terminal of the first switch, and a first terminal of the transistor is coupled to a first voltage;

an organic light emitting diode (OLED), wherein a first terminal of the OLED is coupled to a second terminal of the transistor, and a second terminal of the OLED is coupled to a second voltage; and a second switch, wherein a first terminal of the second switch is coupled to the second ten al of the transistor and the first terminal of the OLED, and a second terminal of the second switch is coupled to the sensing circuit.

16. The apparatus as claimed in claim 15, wherein the control terminal of the first switch and the control terminal of the second switch are coupled to the corresponding scan line.

17. The apparatus as claimed in claim 15, wherein the first switch and the second switch are turned on in the test data period and the display data period.

18. The apparatus as claimed in claim 15, wherein the first switch and the second switch are turned on in the test data period, and the first switch is turned on and the second switch is turned off in the display data period.

19. The apparatus as claimed in claim 15, wherein the first switch and the second switch are configured to be turned on in a first sub-period of the test data period, the first switch is configured to be turned off and the second switch is configured to be turned on in a second sub-period of the test data period, and the first switch is configured to be turned on and the second switch is configured to be turned off in the display data period.

20. A method for sensing a display panel, wherein the display panel comprises a plurality of scan lines, a plurality of data lines and a plurality of pixel circuits, a data input terminal and a gate terminal of a corresponding pixel circuit of the pixel circuits are coupled to a corresponding data line of the data lines and a corresponding scan line of the scan lines respectively, and the method comprising:

sensing, by a sensing circuit, characteristics of the pixel circuits according to a scan-line period for scanning one of the scan lines, wherein the scan-line period comprises display data period and a test data period;

providing, by a source driving circuit, test data to the pixel circuits in the test data period within the scan-line period;

sensing, by the sensing circuit, an electrical characteristic of the corresponding pixel circuit in the test data period within the same scan-line period;

providing, by the source driving circuit, display data to the pixel circuits; and not sensing, by the sensing circuit, the corresponding pixel circuit in the display data period within the same scan-line period.

* * * * *